US006799943B2

(12) United States Patent
Racer et al.

(10) Patent No.: US 6,799,943 B2
(45) Date of Patent: Oct. 5, 2004

(54) CENTRIFUGAL PUMP WITH MULTIPLE INLETS

(75) Inventors: Donald W. Racer, Shelby, OH (US); Michael L. Keith, Mansfield, OH (US)

(73) Assignee: The Gorman-Rupp Company, Mansfield, OH (US)

( * ) Notice: Subject to any disclaimer, the term of this patent is extended or adjusted under 35 U.S.C. 154(b) by 0 days.

(21) Appl. No.: 10/181,913

(22) PCT Filed: Jan. 25, 2001

(86) PCT No.: PCT/US01/02494

§ 371 (c)(1),
(2), (4) Date: Jul. 24, 2002

(87) PCT Pub. No.: WO01/55601

PCT Pub. Date: Aug. 2, 2001

(65) Prior Publication Data

US 2002/0192088 A1 Dec. 19, 2002

Related U.S. Application Data

(60) Provisional application No. 60/178,174, filed on Jan. 26, 2000.

(51) Int. Cl.[7] ..... F04D 29/70

(52) U.S. Cl. ..... 415/116; 415/196; 415/201; 415/206

(58) Field of Search ..... 415/56.1, 116, 415/196, 201, 204, 205, 206

(56) References Cited

U.S. PATENT DOCUMENTS

| | | | | |
|---|---|---|---|---|
| 3,451,343 A | | 6/1969 | Kabele | |
| 3,601,498 A | | 8/1971 | Schroeder | |
| 3,628,881 A | | 12/1971 | Hermann, Jr. | |
| 3,712,755 A | * | 1/1973 | Otto | 415/109 |
| 3,776,659 A | * | 12/1973 | Coon, Jr. | 415/200 |
| 3,778,181 A | * | 12/1973 | McFarlin | 415/56.1 |
| 3,898,014 A | | 8/1975 | Meister et al. | |
| 4,342,538 A | | 8/1982 | Wolford et al. | |
| 4,460,276 A | * | 7/1984 | Arribau et al. | 366/13 |
| 5,156,522 A | | 10/1992 | Tessier | |
| 5,211,530 A | | 5/1993 | Shiffler | |
| 5,591,001 A | * | 1/1997 | Ray et al. | 415/111 |
| 5,599,164 A | | 2/1997 | Murray | |
| 5,660,533 A | | 8/1997 | Cartwright | |

* cited by examiner

*Primary Examiner*—Ninh H. Nguyen
(74) *Attorney, Agent, or Firm*—Watts Hoffmann Co.

(57) ABSTRACT

A centrifugal pump (10) having a pump housing (40) that defines a substantially axial inlet port (32), a substantially radial inlet port (34) and an outlet port (30). An impeller (42) is rotatable within an impeller chamber (58) defined by the housing and is operative to pump fluid from one or both of the inlet ports to the outlet port when the impeller is rotated. A removable cleanout assembly (82) located within and forming part of the axial port includes a structure for supporting a wear plate (76) that is positioned axially adjacent the impeller. The cleanout assembly includes an inlet opening adapted to be configured as an axial inlet port to the pump. The cleanout assembly is removable in order to provide access to the impeller for service or cleaning. Either the axial port or the radial port can serve as an inlet or, alternately, both ports can serve concurrently as inlets to the pump. Mounting flanges (88) associated with each inlet port are adapted to connect to inlet conduits or a cap member.

19 Claims, 6 Drawing Sheets

CENTRIFUGAL PUMP WITH MULTIPLE INLETS

This application claims the benefit of Provisional application No. 60/178,174 filed Jan. 26, 2000.

TECHNICAL FIELD

The present invention relates generally to fluid pumps and, in particular, to a centrifugal pump having multiple inlets.

BACKGROUND ART

Centrifugal pumps are well known in the art and are used for many fluid pumping applications. For example, centrifugal pumps may be used to pump water from one water station to another. They may also be used in construction applications, i.e., to pump water from an excavation cite.

Occasionally, a pump may ingest solid material which can cause clogging of the pump or compromise its operation in other ways. Many times this clogging may necessitate the disassembly of the centrifugal pump in order to remove the material.

Clean-out assemblies allowing access to an impeller chamber have been used in internally self-priming, centrifugal pumps. Examples of pumps having this feature are known as "T-Series" pumps sold by The Gorman-Rupp Company. A self priming pump having clean-out capability is illustrated in U.S. Pat. No. 3,898,014.

DISCLOSURE OF INVENTION

The present invention provides a new and improved centrifugal pump that includes the ability to configure the pump to have one of two inlet configurations. In addition, the pump includes a removable wear plate support/clean-out which provides access to an impeller chamber and which concurrently provides the ability to have alternate inlet configurations.

According to the invention, the centrifugal pump of the present invention includes a pump housing or body which defines an impeller chamber. An impeller, rotatable about an axis, is located within the impeller chamber. The impeller is rotatably driven by a suitable drive source, such as an electric motor or IC combustion engine.

The pump includes a substantially axial port and a substantially radial port which both communicate with the impeller chamber. The pump also includes an outlet port through which pumpage is discharged after passing through the impeller chamber.

In the illustrated embodiment, the pump includes a clean-out port which provides access to the impeller chamber to remove clogs, etc. In the preferred and illustrated embodiment, the removable wear plate/cleanout is an assembly located within the axial port which is removed in order to provide access to the impeller and/or a wear plate which is located axially adjacent the impeller.

According to a feature of the invention, the axial port can serve as an axial inlet to the pump. When the axial port is not used as an inlet port, the port is capped by a cap member or cover.

As indicated above, the pump also includes a radial inlet port through which pumpage is drawn. According to the invention, either the radial port or the axial port can be used as an inlet to the pump. In addition, both ports can be used concurrently as dual inlets to the pump.

According to another feature of the invention, the radial inlet port is arranged such that when it is not being used as an inlet, it can be used to provide access to the impeller chamber in order to remove clogs, debris, etc.

According to a more preferred embodiment, an axis of the radial port and an axis of the outlet port are coincident.

According to a further feature of the invention, the axial port in which the cleanout assembly is mounted is configured to enable the impeller to be removed from the impeller chamber once the cleanout assembly is removed.

Additional features of the invention will become apparent in reading the following detailed description made in connection with the accompanying drawings.

BEST MODE FOR CARRYING OUT THE INVENTION

Figure 1:
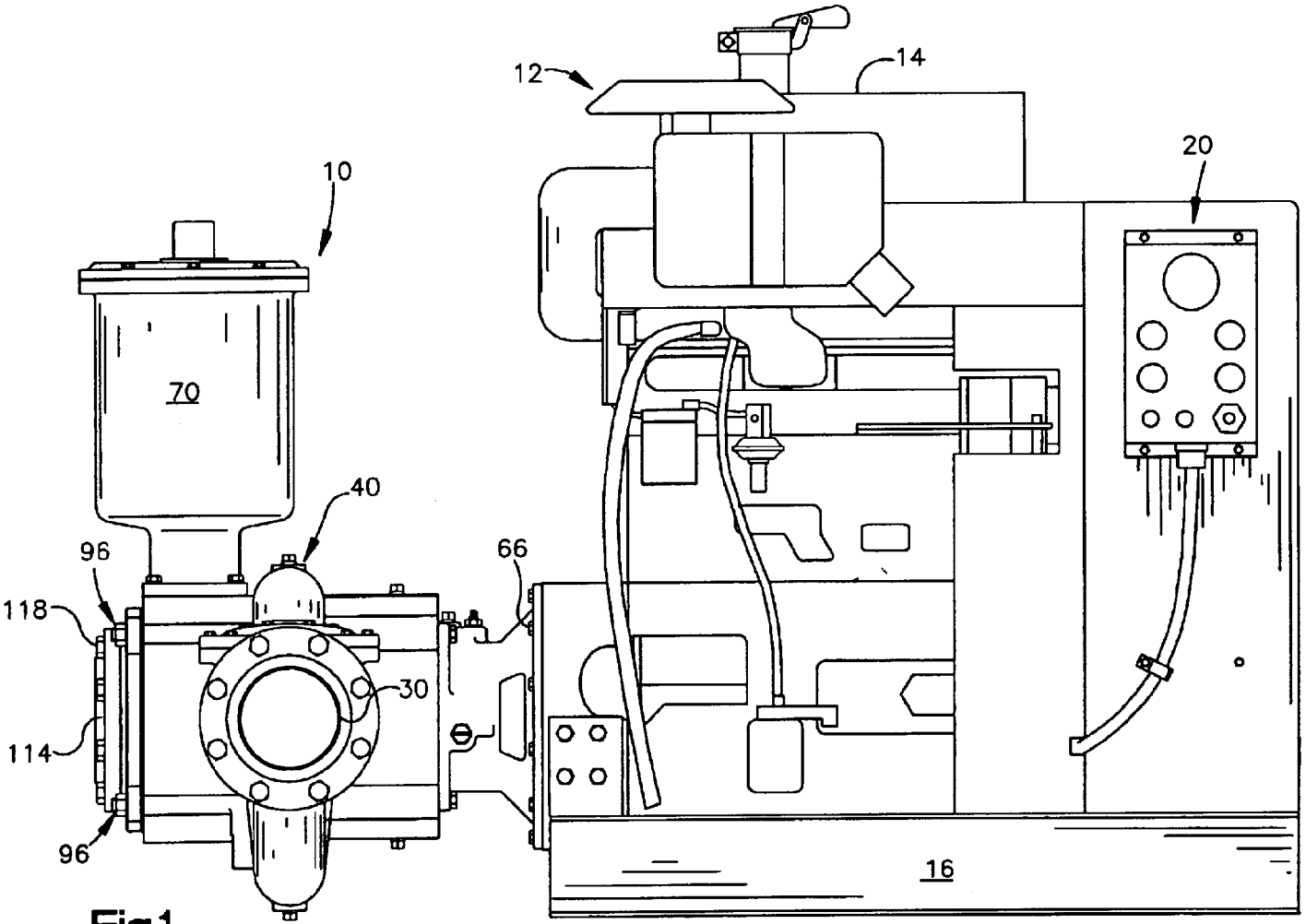
FIG. 1 is a side elevational view of a pumping system including a centrifugal pump constructed in accordance with the preferred embodiment of the invention.

FIG. 1 illustrates an overall view of a centrifugal pump and drive system constructed in accordance with a preferred embodiment of the invention. As seen in FIG. 1, the system includes a centrifugal pump indicated generally by the reference character 10 which is attached to and driven by a drive unit 12. In the illustrated embodiment, the drive unit includes an internal combustion engine 14 supported by a base 16. Controls indicated generally by the reference character 20 are also attached to the base, as well as other drive components (not shown in detail), which operatively connect the engine 14 to the centrifugal pump 10.

Figure 2:
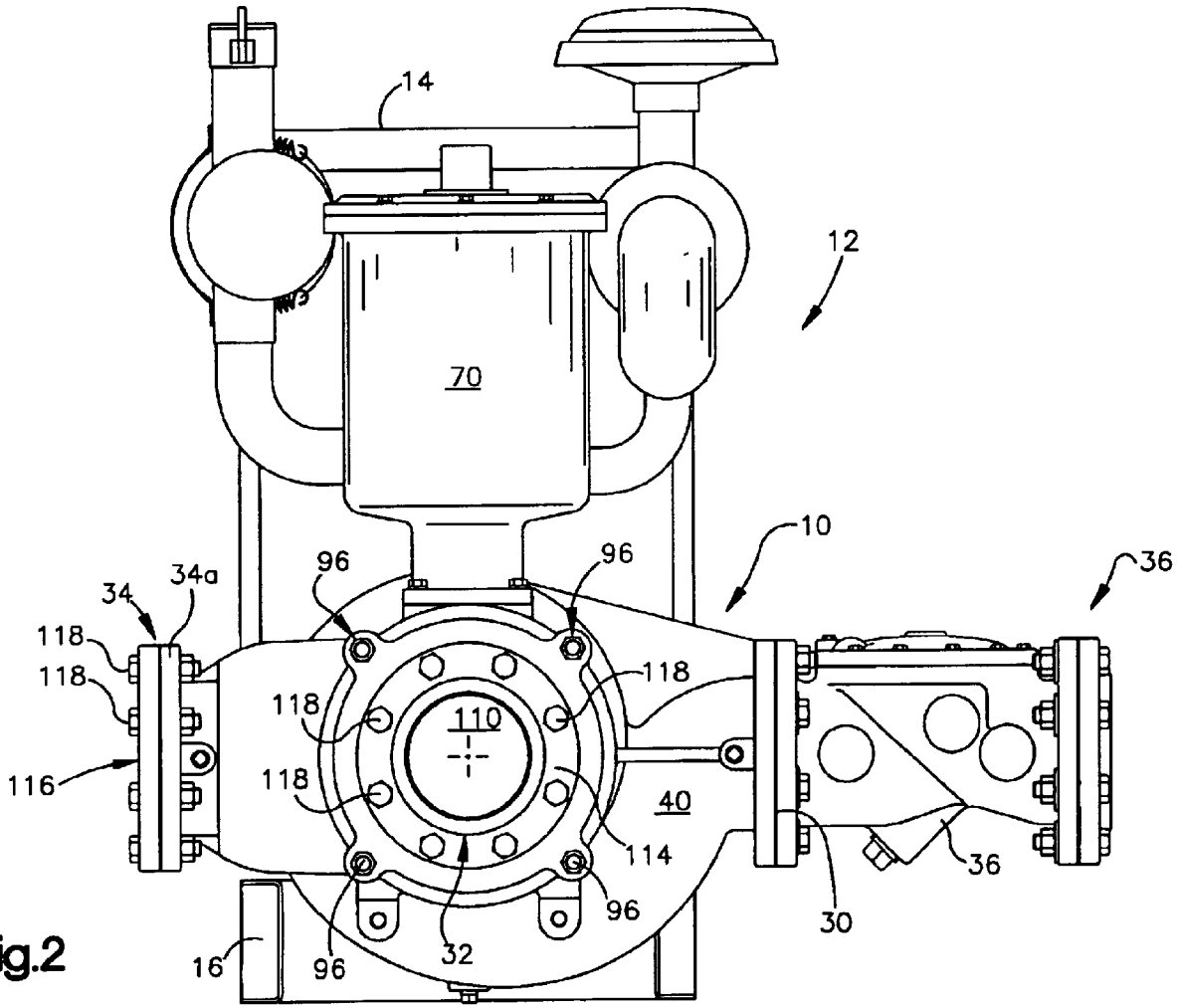
FIG. 2 is another side elevational view of the pump system shown in FIG. 1, but rotated 90° from the position shown in FIG. 1.

Referring also to FIG. 2, the centrifugal pump 10 includes a discharge port or outlet 30 (shown best in FIG. 1) and two inlet ports indicated generally by the reference characters 32, 34 (and shown best in FIG. 2). As will be explained, either port 32, 34 can serve as an inlet to the pump.

As seen in FIG. 2, the unit is shown with a discharge check valve 36 attached to the outlet 30. The discharge check valve is conventional and its operation is well known in the art. It is not considered part of the present invention.

Figure 3:
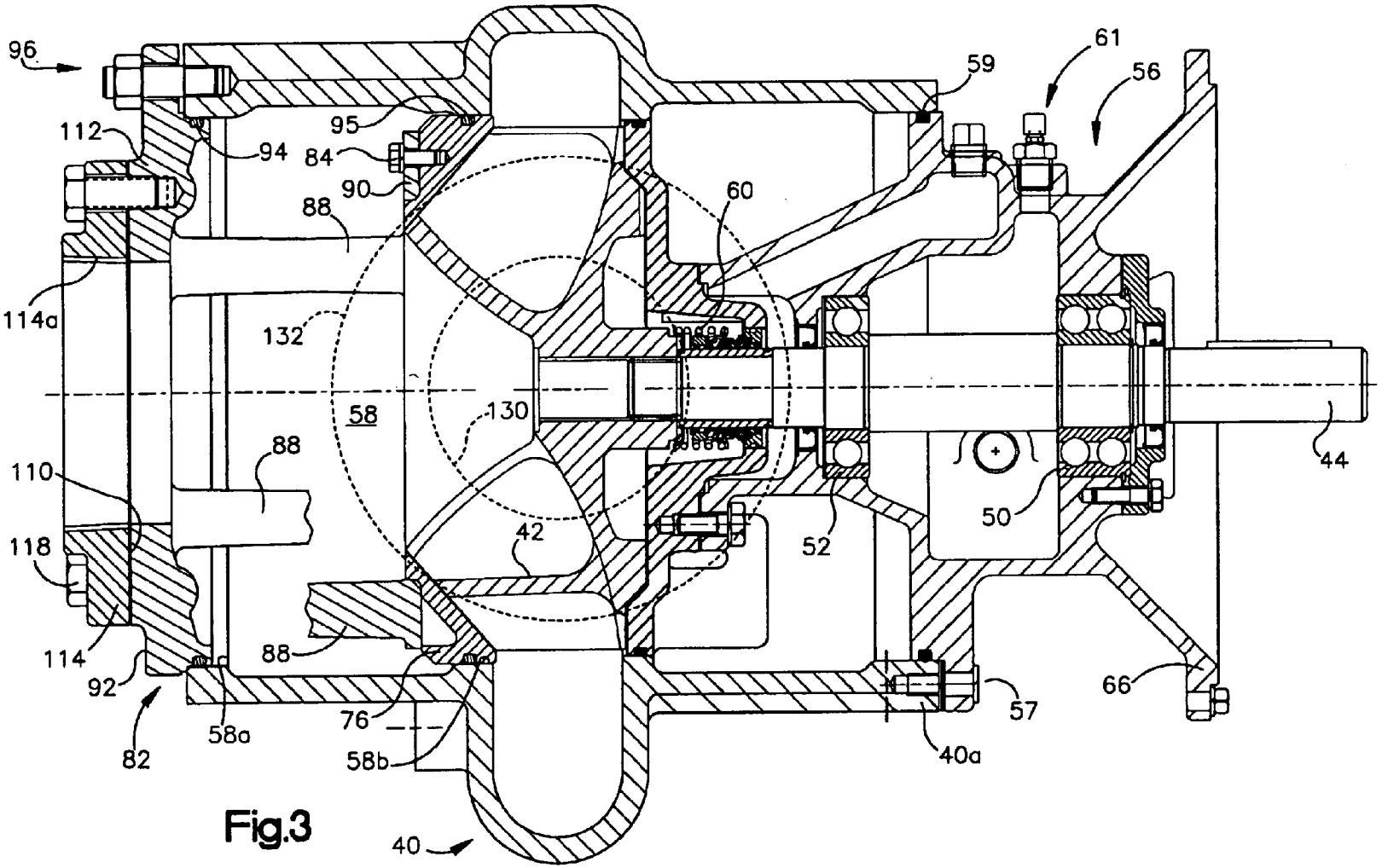
FIG. 3 is a fragmentary, sectional view of the centrifugal pump shown in FIGS. 1 and 2.

The pump 10 includes a volute or housing 40 which, as shown in FIG. 3, surrounds a pump impeller 42. As seen best in FIG. 3, the pump impeller 42, located in an impeller chamber 58, is rotated by a drive shaft 44 which extends from the pump housing 40. The impeller 42 is operatively connected to a drive source which, in the illustrated embodiment, is the engine-based drive unit 12 shown in FIG. 1. As seen in FIG. 3, the pump includes a flange 66 by which it is bolted to the drive unit 12.

Figure 8:
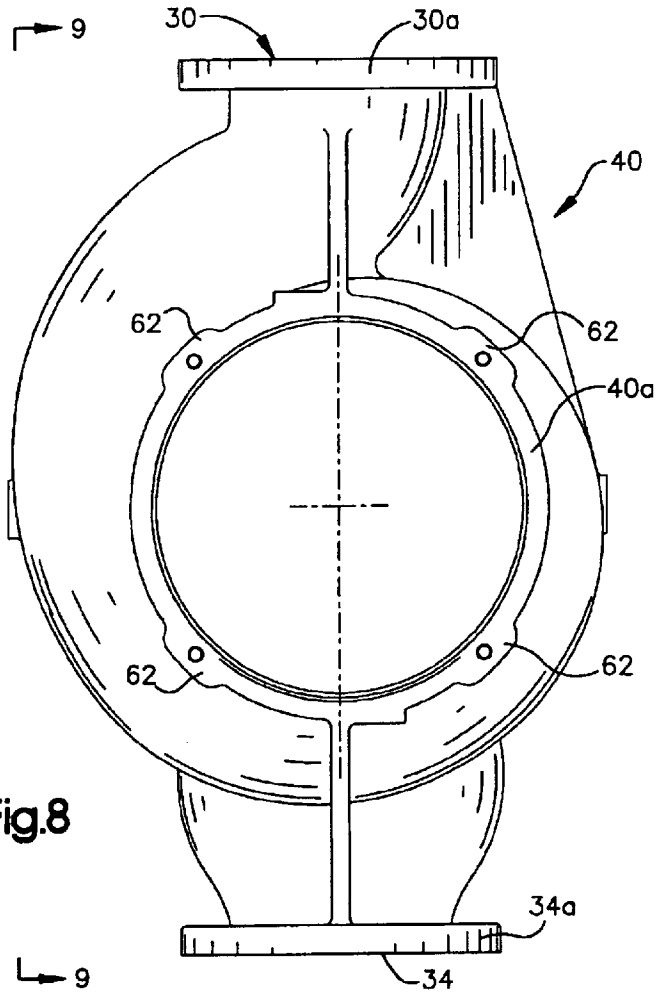
FIG. 8 is a rear elevational view of the pump housing shown in FIG. 6; and, FIG. 9 is a view of the pump housing as seen from the plane indicated by the line 9—9 in FIG. 8.

The drive shaft 44 is rotatably supported by bearings 50, 52. The bearings 50, 52 are mounted within an intermediate or bearing housing 56 which is secured to end flange 40*a* (shown best in FIG. 8) of the volute 40 by a plurality of bolts 57 (only one of which is shown in FIG. 3). In particular, the intermediate housing 56 is bolted to threaded lugs 62 (shown best in FIG. 8) forming part of the end flange 40*a* defined by the volute 40. An O-Ring 59 seals the intermediate housing 56 to the volute 40. In the illustrated embodiment, the mounting flange 66 is an integral part of the intermediate housing 56. The intermediate housing also includes a vent 61 for venting the region between the bearings 54, 56.

Pumpage in the impeller chamber 58 is inhibited from leaking past the drive shaft 44 by a conventional face seal assembly 60. An example of the type of seal that can be used to seal the drive shaft is shown in U.S. Pat. No. 4,342,538, which is hereby incorporated by reference, and which is owned by the present assignee. Details of the seal and its operation can be obtained by reading the above-identified '538 patent, which is attached as Exhibit 1. Other types of seal assemblies, however, can be used to effect sealing of the drive shaft.

As in conventional, rotation of the impeller 42 (by the drive unit 12) draws fluid into the pump chamber 58 from an inlet to the pump and conveys it, under pressure, to the discharge 30.

In the illustrated embodiment, and as best seen in FIGS. 1 and 2, the pump is a prime-assisted type pump and includes a priming hopper 70 which facilitates initial start-up of the pump. As is known in the art, many centrifugal pumps require priming in order to begin the pumping operation. The priming hopper 70 serves this function and it may take the form illustrated in U.S. Pat. No. 5,660,533, which is hereby incorporated by reference, and which is owned by the present assignee. Details of the operation of the priming hopper can be obtained by reading the above-identified '533 patent, which is attached as Exhibit 2.

Figure 5:
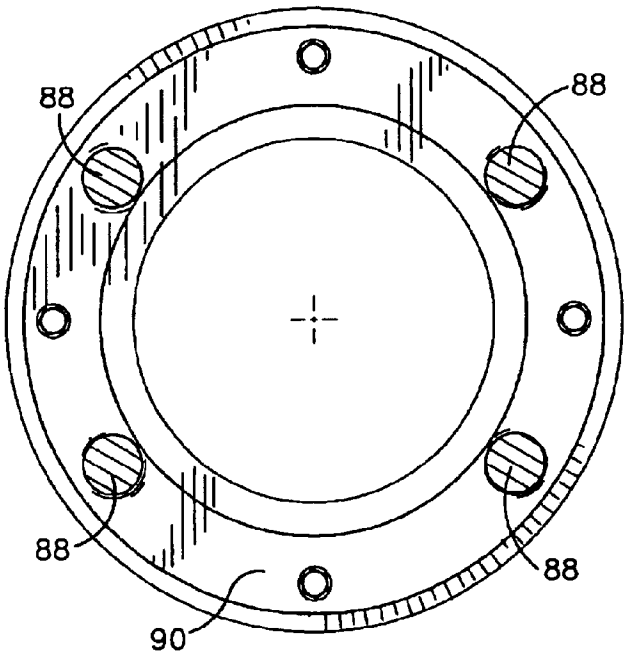
FIG. 5 is a sectional view of the wear plate support/clean-out as seen from the plane indicated by the line 5—5 in FIG. 4.
Figure 4:
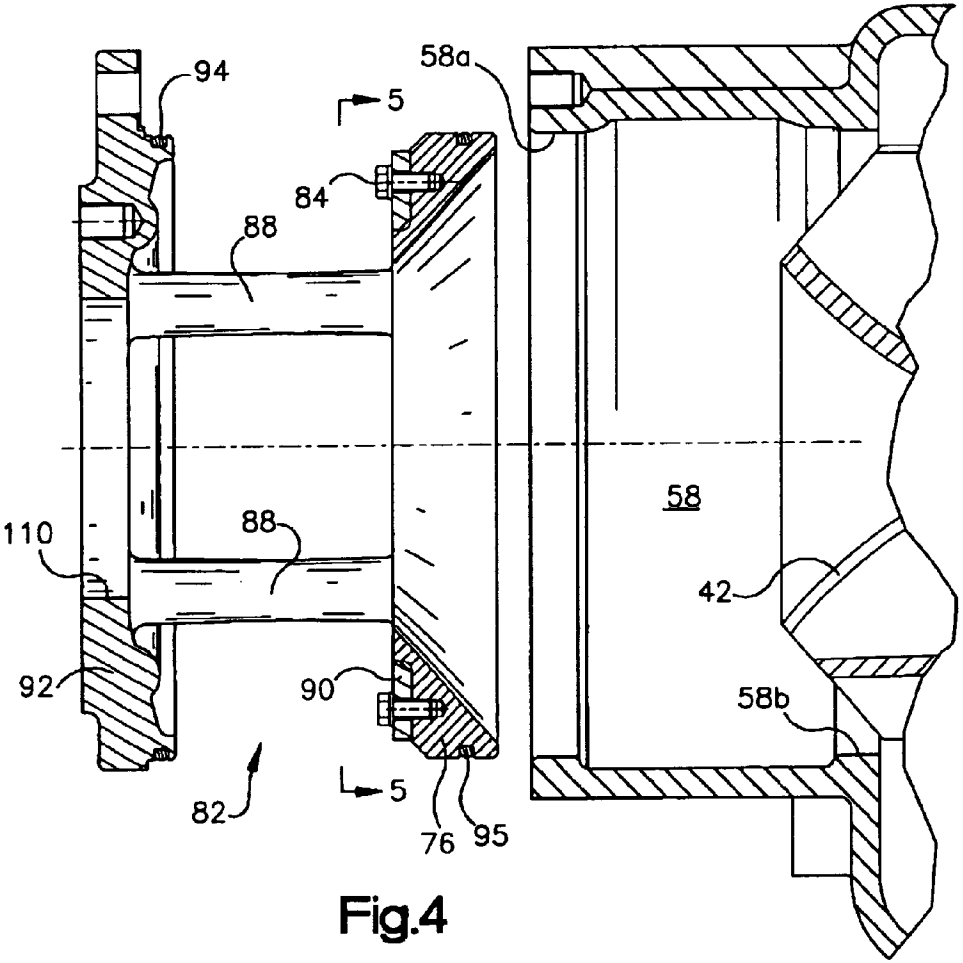
FIG. 4 is a fragmentary, exploded view showing a wear plate support/clean-out separated from the centrifugal pump.

In the illustrated embodiment, and as best shown in FIG. 3, the outboard end of the impeller (the right end of the impeller as viewed in FIG. 3) rotates immediately adjacent a wear plate 76. According to the present invention, the wear plate 76 is removably attached to a support indicated generally by the reference character 82 by a series of bolts 84 (only one is shown in FIG. 3). The wear plate support 82 is best shown in FIG. 4. In particular, the support 82 includes a plurality of column-like standoffs 88 to which a wear plate support ring 90 is attached or integrally formed therewith. See also FIG. 5. The column-like standoffs are attached to the inner side of a cap-like member 92. The cap-like member 92 sealingly engages inside surfaces 58*a*, 58*b* of the pump housing 40 and utilizes O-rings 94, 95 to provide fluid sealing. The cap-like member 92 is held to the housing by a plurality of studs and associated nuts, indicated generally by the reference character 96 (only one of which is shown in FIG. 3).

According to the invention, the support structure 82, including the cap-like member 92 can serve as a removable clean-out assembly to provide access to the impeller chamber 58 of the pump in order to clear debris or other matter from the pump housing. When the bolts 96 are removed, the entire support structure 82 including the wear plate 76 slides leftwardly as viewed in FIG. 3 and is thus removed from the pump chamber 58. Separation of the wear plate support/clean-out assembly 82 is best shown in FIG. 4.

In addition to providing clean-out access to the pump chamber 58, the removable clean-out assembly also allows servicing of the impeller 42 and the associated seal assembly 60. After the clean-out assembly 82 is removed, the impeller can be dismounted from the shaft 44 and removed from the pump through the opening left in the volute upon removal of the clean-out assembly.

The wear plate support/clean-out 82 also provides an additional feature of the invention. The support 82 can be configured as an inlet to the pump. In FIG. 3, this configuration is shown. As seen best in FIG. 3, the cap-like member 92 includes an aperture 110 and also defines a mounting flange 112 to which a pipe flange 114 forming part of an inlet conduit can be attached. The attachment of the conduit flange 114 to the housing flange 112 is conventional and is achieved by means well known in the art using a plurality of bolts 118. The pipe flange 114 includes an internal thread 114*a* (shown in FIG. 3) adapted to receive a threaded pipe/hose connection, nipple, etc.

When the support structure 82 defines the inlet port to the pump, the unit is considered to be in an axial configuration, in that the axis of the inlet conduit is at least parallel to the axis of rotation for the impeller 42. Preferably, the axis of the conduit is coincident with the axis of rotation.

When the support/clean-out 82 is used to provide the sole inlet to the pump 10, the port 34 must be sealed. This configuration is shown in FIG. 2. To achieve this sealing, a blind flange plate 116 is secured, by a plurality of bolts 118, to a mounting flange 34*a* forming part of the port 34.

Figure 7:
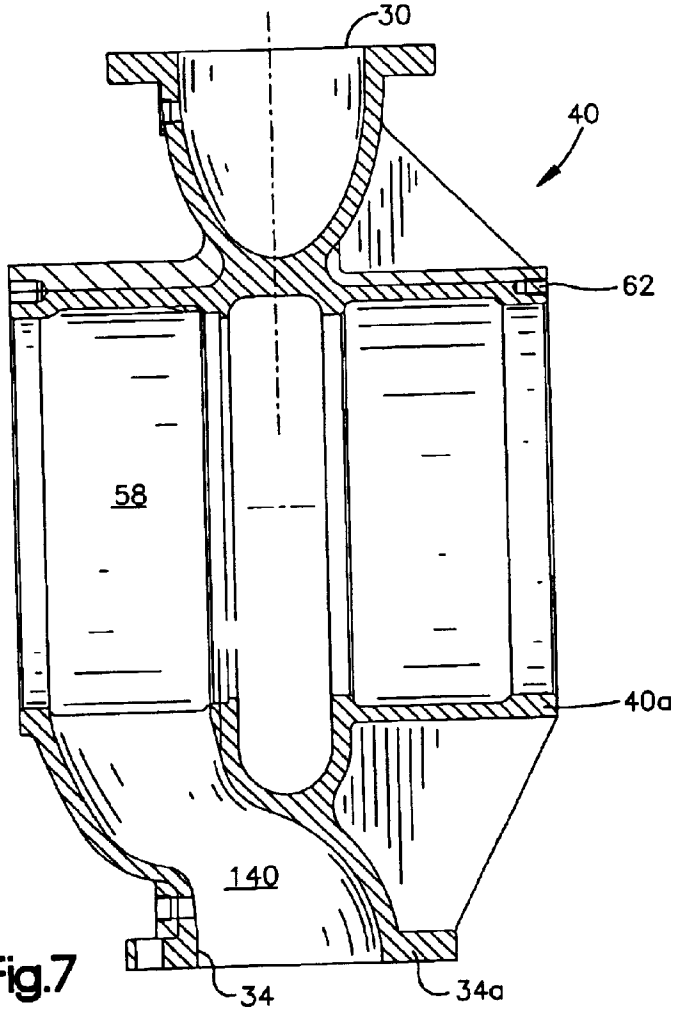
FIG. 7 is a sectional view of the pump housing as seen from the plane 7—7 in FIG. 6.
Figure 6:
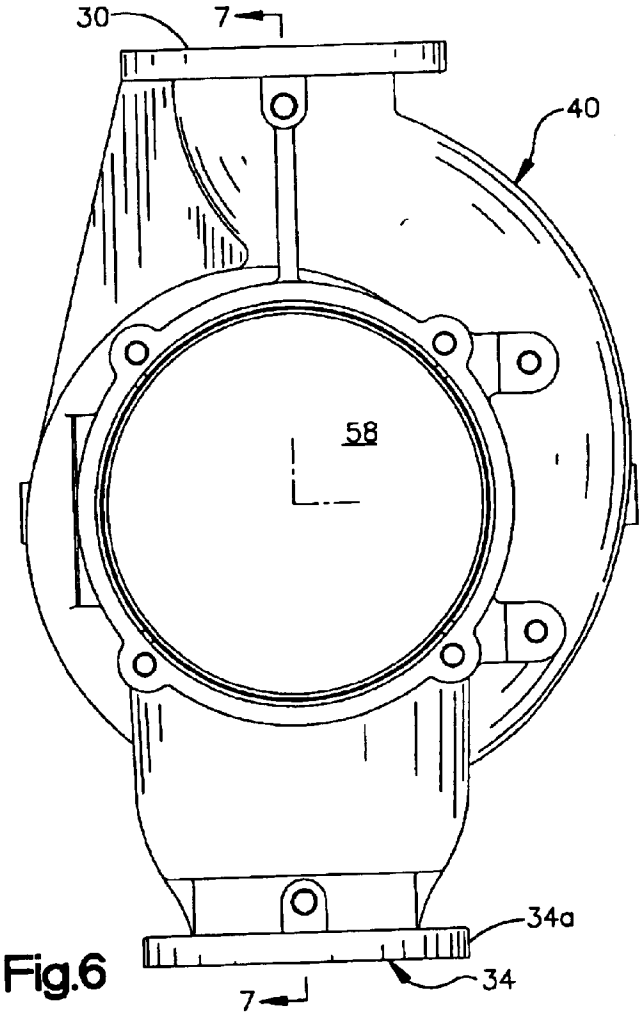
FIG. 6 is a side elevational view of a volute housing forming part of the centrifugal pump shown in FIG. 1.
Figure 9:
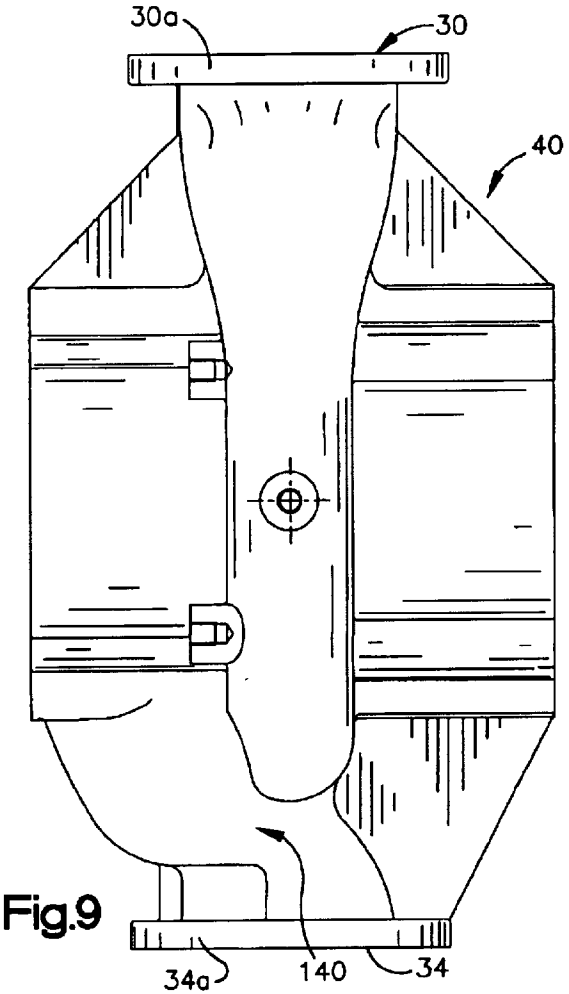

As will be explained below, the blind flange 116 can be removed when the port 34 is to serve as an inlet. According to a feature of the invention, the blind flange 116 can also serve as a clean-out cover when the port 34 is not serving as an inlet. By removing the blind flange 116, access to the impeller chamber 58 can be provided to facilitate removal of material, etc from the pump chamber 58 since the port 34 communicates with the chamber 58. This relationship is best shown in FIG. 7.

According to the invention, when an alternate inlet configuration is desired, the aperture 110 in the support/clean-out 92 can be capped using, for example, the blind flange 116 that in FIG. 2 is used to seal the inlet port 34. Alternately, the invention contemplates the use of a support/clean-out assembly 82 that has a solid end cap at its outermost end and, in this configuration, serves simply as a clean-out assembly rather than as a means for mounting an inlet conduit.

According to the invention, the inlet to the pump may be provided by the port 34. In this configuration, the port 32 would be sealed either by a support/clean-out 82 having a solid end cap or by capping the aperture 110 with a blind flange 116. In this configuration, the inlet would be considered a radial port, its axis being orthogonal to the rotational axis of the impeller 42.

According to another feature of the invention, both ports 32 and 34 can serve as concurrent inlets to the pump. It has been found that the pumping efficiency of the disclosed pump is improved when both inlets are used concurrently to provide source fluid to the pump chamber 58. In addition, this feature can be utilized in order to facilitate attachment of the pump to a piping/hose system. For example, if the centrifugal pump 10 is configured as a "8 inch" pump, i.e., the diameter of the inlet (and outlet) is 8 inches, significant effort may be needed to attach conduits to the pump flanges. This task can be eased significantly by utilizing a pair of 6 inch conduits (with suitable flange adapters) which are more easily manipulated by personnel installing the pump at the job site. Generally, it has been found that 8 inch conduit requires the aid of lifting machinery, whereas 6 inch conduit can be handled directly by personnel.

In the preferred embodiment, and as seen best in FIG. 3, the axes of the radial and discharge ports 34, 30 are parallel and preferably coincident. In FIG. 3, the inner peripheries of both the radial and discharge ports are indicated by the inner phantom line 130. The outer phantom line 132 indicates the outer peripheries of the mounting flanges.

Referring also to FIGS. 6–9 (which illustrate details of the pump housing 40), the method by which alignment of the radial inlet and discharge ports 34, 30 is achieved, is illustrated. The pump housing includes a jogged passage 140 which communicates the radial inlet 34 with the impeller pump chamber 58. This is the same chamber which the axial inlet directly communicates with. The jogged passage 140 allows the radial inlet 34 to be aligned with the discharge outlet 30. The passage 140 also allows access to the pump chamber 58 when the inlet 34 is capped and is used as a clean-out port as described above.

Although the invention has been described with a certain degree of particularity, it should be understood that those skilled in the art can make various changes to it without departing from the spirit or scope of the invention as hereinafter claimed.

We claim:

1. A centrifugal pump comprising:

a) an impeller rotatable within an impeller chamber;

b) an axial port defined by a clean-out member secured to a housing forming part of said pump, said axial port in fluid communication with said impeller chamber and adapted to serve as a fluid inlet to said pump under predetermined operating conditions; and, c) a radial port including a passage for communicating said radial port with said impeller chamber, said radial port adapted to serve as another inlet to said pump under predetermined operating conditions, whereby either of said axial and radial ports can serve as a fluid inlet to said pump, or both of said axial and radial ports can concurrently serve as fluid inlets to said pump.

2. The centrifugal pump of claim 1, wherein said clean-out member also provides support for a wear ring positioned axially adjacent said impeller.

3. The centrifugal pump of claim 1, wherein said radial port is arranged to serve as a clean-out when only said axial port is being used as an inlet to said pump.

4. The centrifugal pump of claim 1, wherein an axis of said radial port and an axis of an outlet port are coincident.

5. The centrifugal pump of claim 1, wherein said clean-out member defines an apertured mounting flange to which a conventional pipe flange can be secured.

6. A centrifugal pump comprising:

a) an impeller rotatable within an impeller chamber;

b) an axial port defined by a removable clean-out member secured to a housing forming part of said pump, said axial port in fluid communication with said impeller chamber adapted to serve as an inlet to said pump under predetermined operating conditions; and, c) said clean-out member providing support for a replaceable wear ring located axially adjacent said impeller, but spaced axially from said axial port.

7. A centrifugal pump, comprising:

a) a pump housing defining a substantially axial inlet port, a substantially radial inlet port and an outlet port;

b) said substantially axial inlet and substantially radial inlet ports being in fluid communication with said impeller chamber;

c) said housing further defining an impeller chamber;

d) an impeller rotatable within the impeller chamber operative to pump fluid from one or both of said inlet ports to said outlet port when said impeller is rotated;

e) a removable clean-out assembly located within and forming part of said axial port, said clean-out assembly including support structure for supporting a wear plate axially adjacent said impeller; and, f) said clean-out assembly adapted to be configured to serve as an axial inlet port to said pump, whereby either of said axial and radial ports can serve as a fluid inlet to said pump, or both of said axial and radial ports can concurrently serve as fluid inlets to said pump.

8. The pump of claim 7, wherein said clean-out assembly is removable to provide access to said impeller chamber in order to provide access to said impeller.

9. The pump of claim 7, wherein said pump is adapted to be configured as a pump with both a radial and axial inlet port, wherein pumpage is drawn into said impeller chamber concurrently through said radial and axial ports.

10. The pumps of claim 7, wherein said radial and axial ports are each configured with a flange connectable to an inlet conduit when said respective port is used as an inlet to said pump and a cap member when said port is not being used as an inlet.

11. The apparatus of claim 7, wherein said pump further includes a priming hopper.

12. The apparatus of claim 7, wherein said impeller is driven by an IC combustion engine.

13. The apparatus of claim 7, wherein said wear ring is supported in a predetermined location with respect to said impeller by a plurality of standoffs attached to a mounting member which is connectable to a flange forming part of said axial port.

14. The centrifugal pump of claim 7, wherein an axis of said radial port and an axis of said outlet port are coincident.

15. A centrifugal pump comprising:

a) an impeller rotatable within an impeller chamber;

b) an axial port defined by a clean-out member secured to a housing forming part of said pump, said axial port adapted to serve as an inlet to said pump under predetermined operating conditions; and, c) a radial port including a passage for communicating said radial port with said impeller chamber, said radial port adapted to serve as another inlet to said pump under predetermined operating conditions, said radial port being arranged to serve as a clean-out when only said axial port is being used as an inlet to said pump.

16. A centrifugal pump comprising:

a) an impeller rotatable within an impeller chamber;

b) an axial port defined by a clean-out member secured to a housing forming part of said pump, said axial port adapted to serve as an inlet to said pump under predetermined operating conditions;

c) a radial port including a passage for communicating said radial port with said impeller chamber, said radial port adapted to serve as another inlet to said pump under predetermined operating conditions; and, d) an axis of said radial port and an axis of an outlet port are coincident.

17. A centrifugal pump, comprising:

a) a pump housing defining a substantially axial inlet port, a substantially radial inlet port and an outlet port;

b) said housing further defining an impeller chamber;

c) an impeller rotatable within the impeller chamber operative to pump fluid from one or both of said inlet ports to said outlet port when said impeller is rotated; and, d) a removable clean-out assembly located within and forming part of said axial port, said clean-out assembly including support structure for supporting a wear plate axially adjacent said impeller;

e) said clean-out assembly adapted to be configured to serve as an axial inlet port to said pump;

f) said radial and axial ports each being configured with a flange connectable to an inlet conduit when said respective port is used as an inlet to said pump and a cap member when said port is not being used as an inlet.

18. A centrifugal pump, comprising:

a) a pump housing defining a substantially axial inlet port, a substantially radial inlet port and an outlet port;

b) said housing further defining an impeller chamber;

c) an impeller rotatable within the impeller chamber operative to pump fluid from one or both of said inlet ports to said outlet port when said impeller is rotated; and, d) a removable clean-out assembly located within and forming part of said axial port, said clean-out assembly including support structure for supporting a wear plate axially adjacent said impeller;

e) said clean-out assembly adapted to be configured to serve as an axial inlet port to said pump;

f) said wear ring being supported in a predetermined location with respect to said impeller by a plurality of standoffs attached to a mounting member which is connectable to a flange forming part of said axial port.

19. A centrifugal pump, comprising:

a) a pump housing defining a substantially axial inlet port, a substantially radial inlet port and an outlet port, an axis of said radial inlet port and an axis of said outlet port being coincident;

b) said housing further defining an impeller chamber;

c) an impeller rotatable within the impeller chamber operative to pump fluid from one or both of said inlet ports to said outlet port when said impeller is rotated; and, d) a removable clean-out assembly located within and forming part of said axial port, said clean-out assembly including support structure for supporting a wear plate axially adjacent said impeller;

e) said clean-out assembly adapted to be configured to serve as an axial inlet port to said pump.

* * * * *